United States Patent [19]

Hartke

[11] Patent Number: 4,960,254

[45] Date of Patent: Oct. 2, 1990

[54] PORTABLE HOLDER TO SUPPORT A RECAPPED CONTAINER OF EFFERVESCENT LIQUIDINAN INVERTED POSITION TO RETAIN THE LIQUIDS FRESHNESS

[76] Inventor: Dennis V. Hartke, 4825 Mill Pond Loop, Auburn, Wash. 98002

[21] Appl. No.: 277,360

[22] Filed: Nov. 29, 1988

[51] Int. Cl.[5] ..... A47G 23/02

[52] U.S. Cl. ..... 248/146; 211/74

[58] Field of Search ..... 248/311.3, 146; 211/74; 206/427, 446, 151, 147, 158; 215/1 C, 12 R; D6/462, 466, 449; D7/70

[56] References Cited

U.S. PATENT DOCUMENTS

| | | | |
|---|---|---|---|
| 3,331,500 | 7/1967 | Poupitch | 206/151 |
| 3,346,106 | 10/1967 | Gooding | 206/151 |
| 3,480,152 | 11/1969 | Walsh | 211/74 |
| 3,482,724 | 12/1969 | Heaton | 215/10 |
| 3,601,253 | 8/1971 | Poupitch | 206/158 X |
| 3,752,305 | 8/1973 | Heyne | 206/147 |
| 4,328,904 | 5/1982 | Iverson | 220/229 X |

FOREIGN PATENT DOCUMENTS

| | | | |
|---|---|---|---|
| 318755 | 10/1902 | France | 248/311.2 |
| 2595662 | 9/1987 | France | 206/147 |
| 2164544 | 3/1986 | United Kingdom | 206/446 |

*Primary Examiner*—Blair M. Johnson

[57] ABSTRACT

A holder, in various embodiments, holds a previously opened, now recapped, bottle, partially filled with an effervescent liquid, in an inverted position. The effervescent liquid forms a gas seal about the interior of the replaced cap. In some embodiments, a liquid drip basin portion of the holder is included to collect, if necessary, some possible seepage. Preferably, the holder is shaped to place the bottle, as so supported in the holder, on the inside door shelves of a refrigerator.

4 Claims, 7 Drawing Sheets

PORTABLE HOLDER TO SUPPORT A RECAPPED CONTAINER OF EFFERVESCENT LIQUIDINAN INVERTED POSITION TO RETAIN THE LIQUIDS FRESHNESS

TECHNICAL FIELD

The invention relates to a container holder for storing a resealed container having effervescent liquid therein.

BACKGROUND ART

There have been many advances in the art of bottling, capping, and sealing of containers. There has not however ever been an effective method of resealing opened bottles having effervescent liquid therein, using the original cap. Threaded caps are used extensively in the capping of containers having effervescent liquid inside, and are very effective on the first seal, however after the container is opened, the effervescent liquid therein begins to lose its "fizz", due to the loss of gas. By replacing the cap, the escapement of gas is slowed but not stopped due to the continued escapement of gas past the now unsealed, but replaced cap. Racks or container supports for supporting bottles are known in the art, most particularly for wine bottles. These racks or supports ordinarily support the bottle if sealed with a cork in a mostly horizontal position with the liquid therein in contact with the cork, to insure that the cork remains moist, because a dried-out cork is difficult to remove and/or may crack during removal. However, in the pas, if the bottle has been sealed with a threaded cap or a cap other than a cork, it is racked or supported in a manner that will prevent the liquid from coming in contact with the cap to prevent leakage. However, the self life of an opened then recapped container of effervescent liquid stored in this "prior-art" position, is limited to hours, due to continued gas escapement.

The prior art devices for supporting containers in a mostly horizontal position are not suitable for supporting "state of the art" effervescent liquid containers, partially because of size and shape and the possible seepage that can occur around the cap if not replaced properly, but also because of the preferred storage place, the conventional refrigerator. The numerous varieties of liquids inside the various containers that may well entice a person to have three or four opened, partially consumed containers to store at any one time.

SUMMARY

It is the object of the present invention to provide a means of racking and/or storing resealed containers having effervescent liquid therein, and is designed to be used in conventional coolers or home refrigerators.

The invention is comprised of a bottle support which is structured in such a way that the container is supported in such a manner that the liquid inside the container is in contact with the cap. Under the cap end of the container is a trough, pan, or basin for collecting any of the liquid content of the container that may seep past the cap and thus preventing dripping of the liquid inside the cooler or refrigerator.

Once a container having effervescent liquid therein with a threaded cap or other resealable cap is opened it is almost impossible to reseal the container and keep the effervescent liquid inside fresh for more than a few hours. By supporting the container with the liquid in contact with the cap, it forms a gas seal which prevents the escapement of the "gas" that is associated with effervescent liquids. The supporting of a container having effervescent liquid inside with threaded type or other resealable caps has always been accomplished by using the base of the container as the support to insure the cap is above the level of the liquid inside to prevent any seepage of the liquid. This present invention will change the "state of the art" for storing and preserving freshness of resealed resealable containers without regard for dripping or seepage.

DRAWINGS

The various embodiments of this holder to maintain a previously opened effervescent liquid bottle partially emptied and recapped, in an inverted position whereby the remaining liquid therein forms a gas seal about the cap is illustrated in the drawing, wherein.

DESCRIPTION OF THE PREFERRED EMBODIMENT

Figure 2:
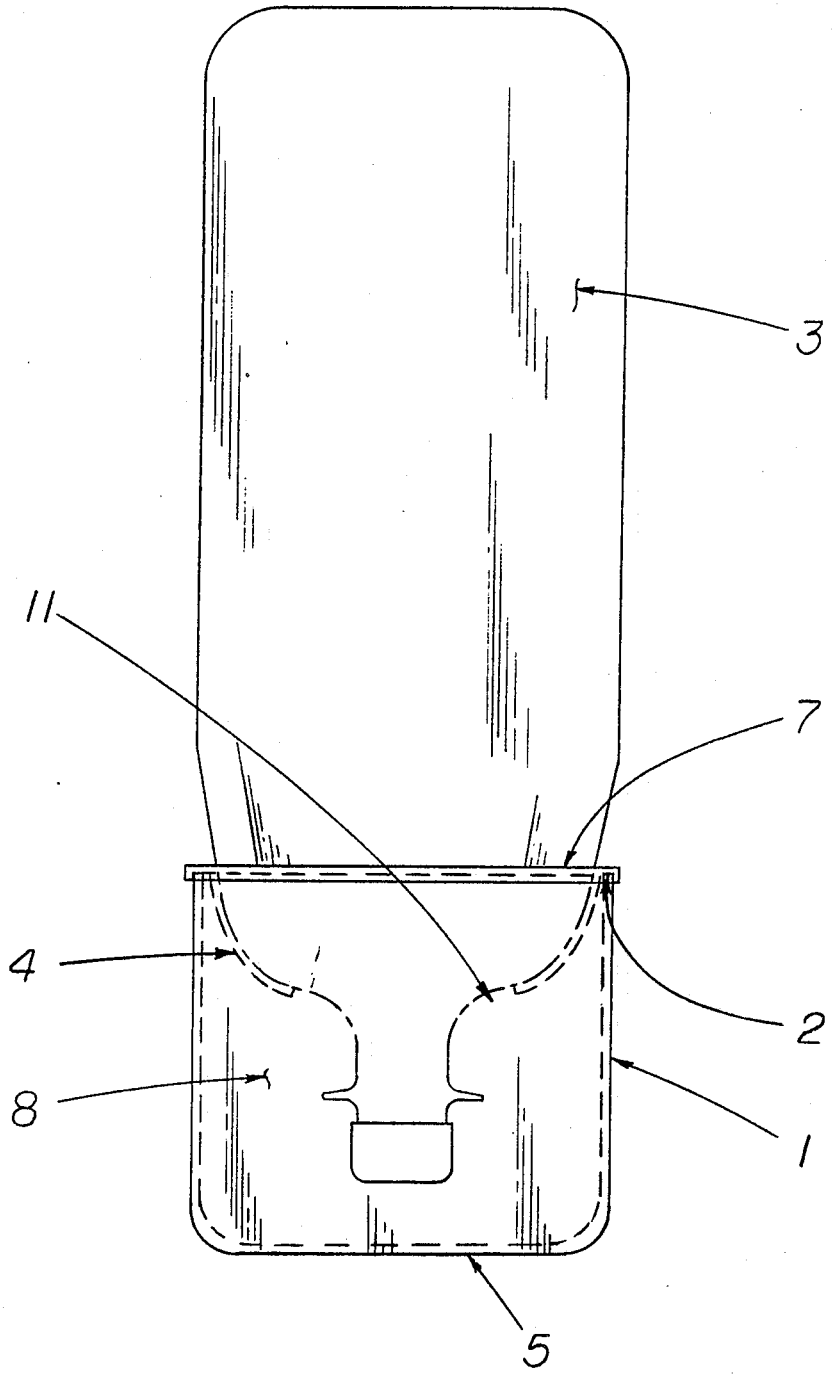
FIG. 2 is a front view of a species of a holder of the present invention, showing the holder as it would support a recapped bottle to preserve its freshness.

The container holder of the present invention generally is comprised of a base portion (5), vertical supports (1), a top portion (7), and a container nest (4). As shown in FIG. 2, the base portion (5) is square but may be other shapes. Perpendicular to the base (5) are vertical supports (1), of which there are four, although any number of vertical supports could be used. In the illustration shown in FIG. 2, the base (5) and the vertical supports (1) are integral parts and form the drip basin (8) The container holder top (7) is attached to and supported by the vertical supports (1) by means of the channel (2) in the support top (7). The support top (7) has an opening (11) and a formed pocket (4) for supporting the container (3) in an inverted mostly vertical position.

Figure 3:
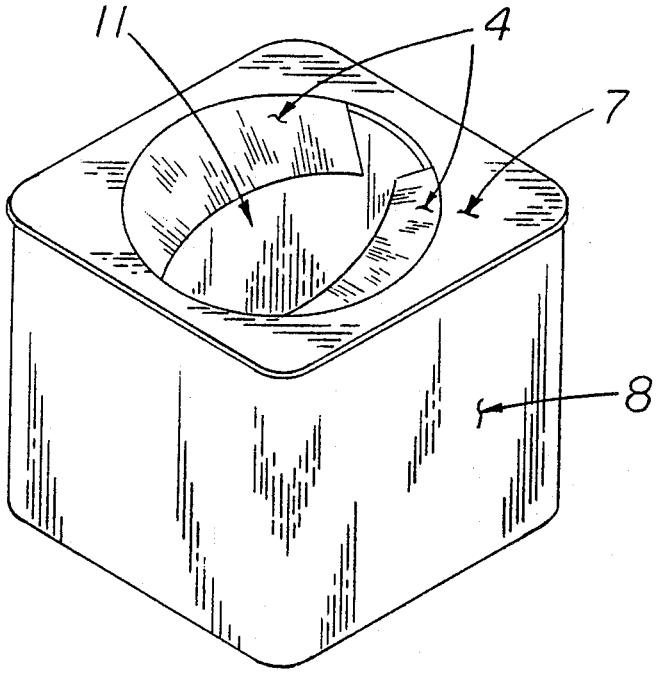
FIG. 3 is a perspective view of the holder of the same species as shown in FIG. 2.

FIG. 3 shows a perspective view of how the base (5) and vertical supports (1) in FIG. 2 form the drip basin (8). FIG. 3 also shows a perspective view of the top (7) with opening (1) and formed pocket (4).

A second species of a container holder is shown in FIG. (4). The container holder is comprised of the same style of drip basin (8) having vertical supports (1) and base (5) as the species in FIG. 2. The container holder in FIG. 4 has a top (7) and is attached to and supported by the vertical supports (1) by means of the channel (2) in the support top (7). The top of this species has an opening (11) large enough to receive the exterior of an inverted container (3). The inverted container is supported by the top of the inverted container (3), resting on the base (5), with the opening (11) in top (7) used to stabilize the inverted container (3).

Figure 4:
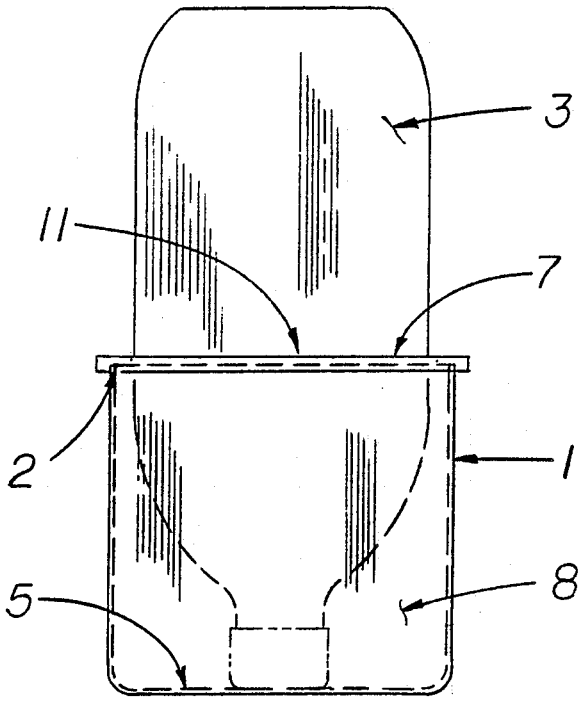
FIG. 4 is a front view of a second species of a holder of the present invention as it may be used to support a 12 or 16 oz. recapped bottle.
Figure 5:
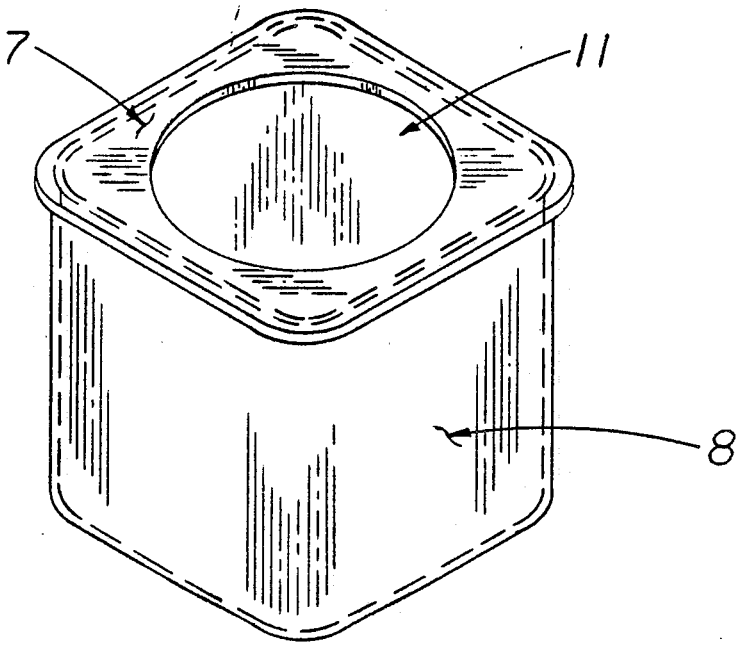
FIG. 5 is a perspective view of the holder of the same species as shown in FIG. 4.

FIG. 5 is a perspective view of the container holder described and shown in FIG. 4. FIG. 5 shows a perspective view of the top (7) with the opening (11) as they would be supported by the drip basin (8).

Figure 6:
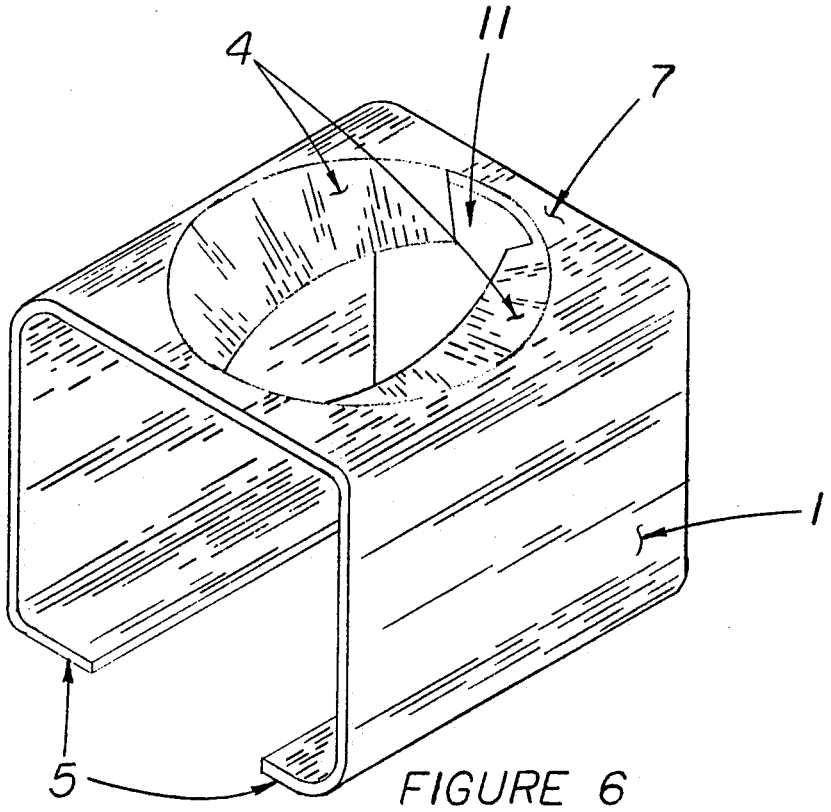
FIG. 6 is a perspective view of a third species of a holder of the present invention showing the versatility in design capable of being developed to someone skilled in the art.

FIG. 6 shows a third species of the container holder comprised of a base portion (5), vertical supports (1), of which there are two, a top portion (7), an opening (11), and a container nest (4). In this species, the top (7), vertical supports (1), and the base (5) are formed integral parts. The top (7) has an opening (11), and a container nest (4), for supporting the inverted container in the same manner as shown in FIG. 2.

Figure 7:
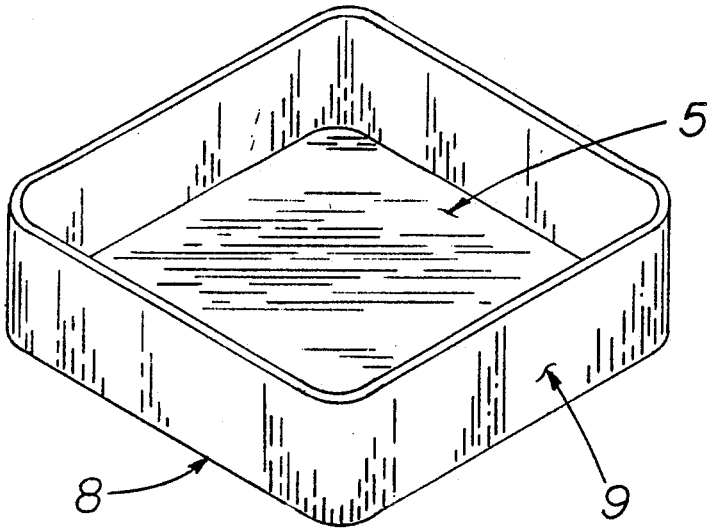
FIG. 7 is a perspective view of a drip pan attachment for use with the species of holder in FIG. 6.

FIG. 7 shows a drip basin (8) comprised of a base (5) and vertical supports (9). The drip basin (8) in FIG. 7 is designed to be used with the container holder shown in FIG. 6, although it is a separate piece. The drip basin (8) in FIG. 7 can be designed to slip between the vertical supports (1) in FIG. 6, or may be designed to have the vertical supports (1), and base (5) of the container holder in FIG. 6 set inside the drip basin (8) in FIG. 7. In either design, the drip basin (8) would be positioned below the opening (11) and the container nest (4).

Figure 9:
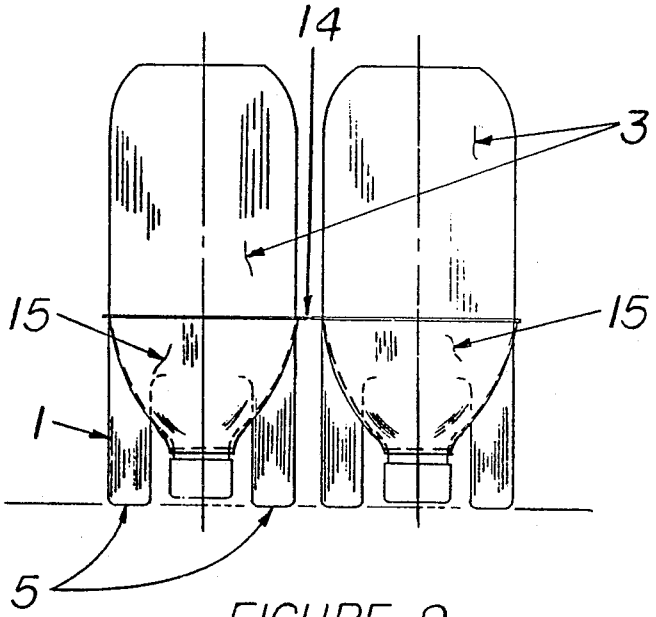
FIG. 9 is an end view of the holder of the same species as the holder in FIG. 8.
Figure 8:
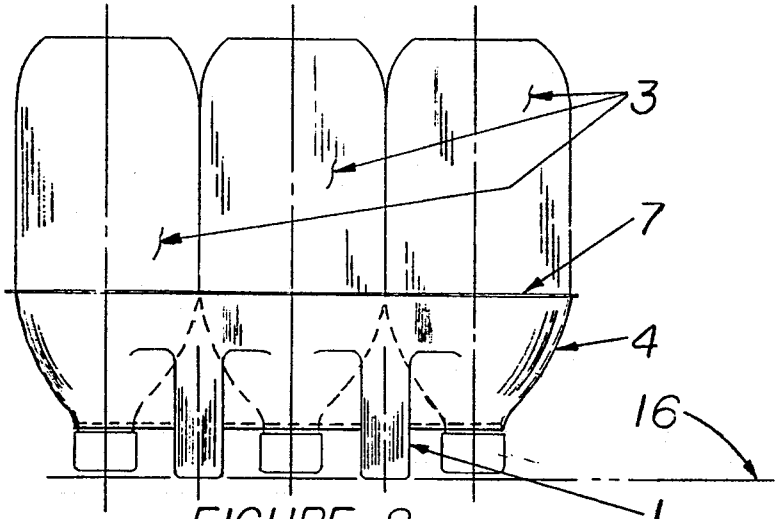
FIG. 8 is a front view of a fourth species of the present invention showing it designed and used as a (6 pack) carton, and how it can be inverted and used as a holder to support the bottles in an inverted position.
Figure 10:
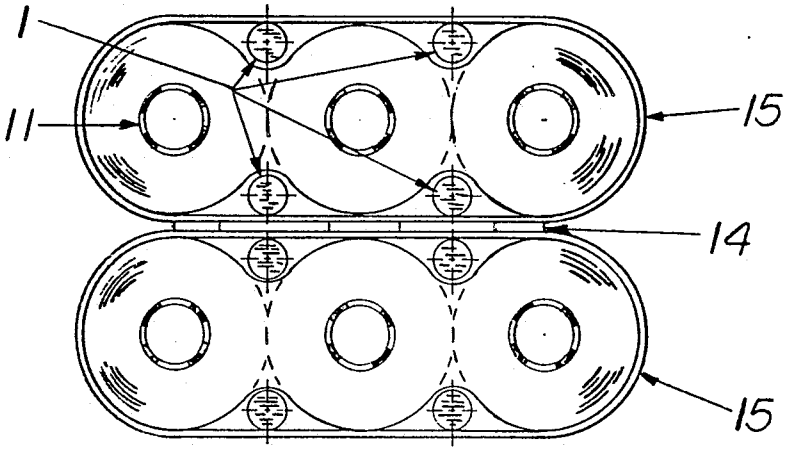
FIG. 10 is a bottom view of the holder of the same species as the holder in FIG. 8.

A fourth species of a container holder of the present invention is shown in FIGS. 8 thru 12. This species of container holder is designed to hold three containers in the inverted position. FIGS. 8 and 9, which are front and end views, respectively, show the container holder (15) in the inverted position supported by surface (16). The container holder (15) is comprised of vertical supports (1), base (5), container nest (4), and top portion (7). FIG. 9 and FIG. 10 show two container holders (15) connected by tab (14), thereby allowing these two container holders (15) to act as one unit for holding, storing, or carrying six containers at one time. The two container holders (15) can be separated by removal of tab (14)

Figure 12:
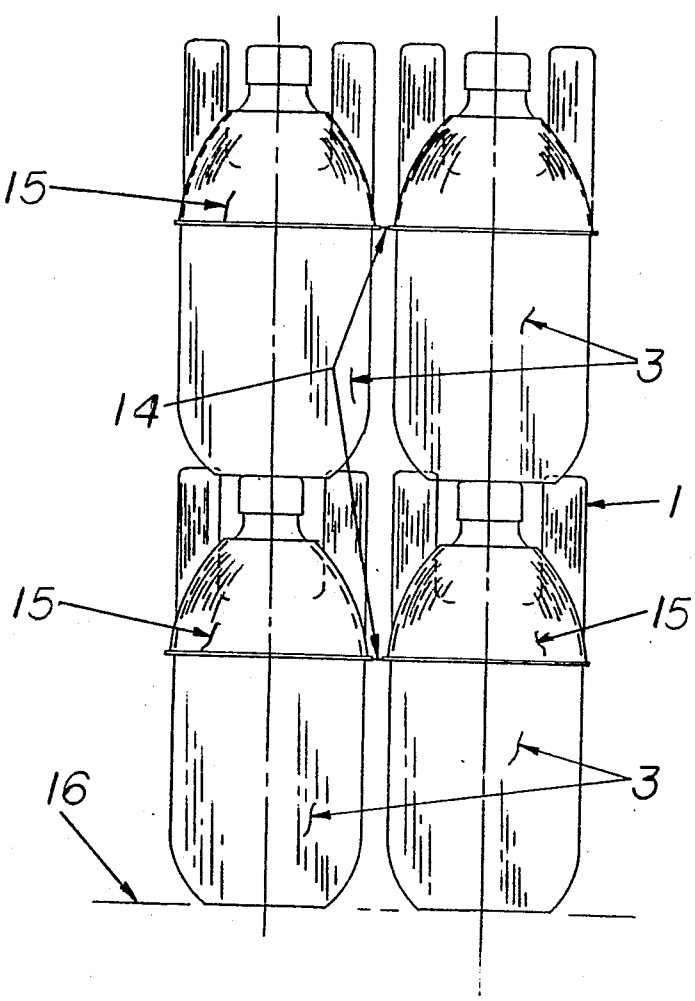
FIG. 12 is an end view of the holder as shown in use in FIG. 11.
Figure 11:
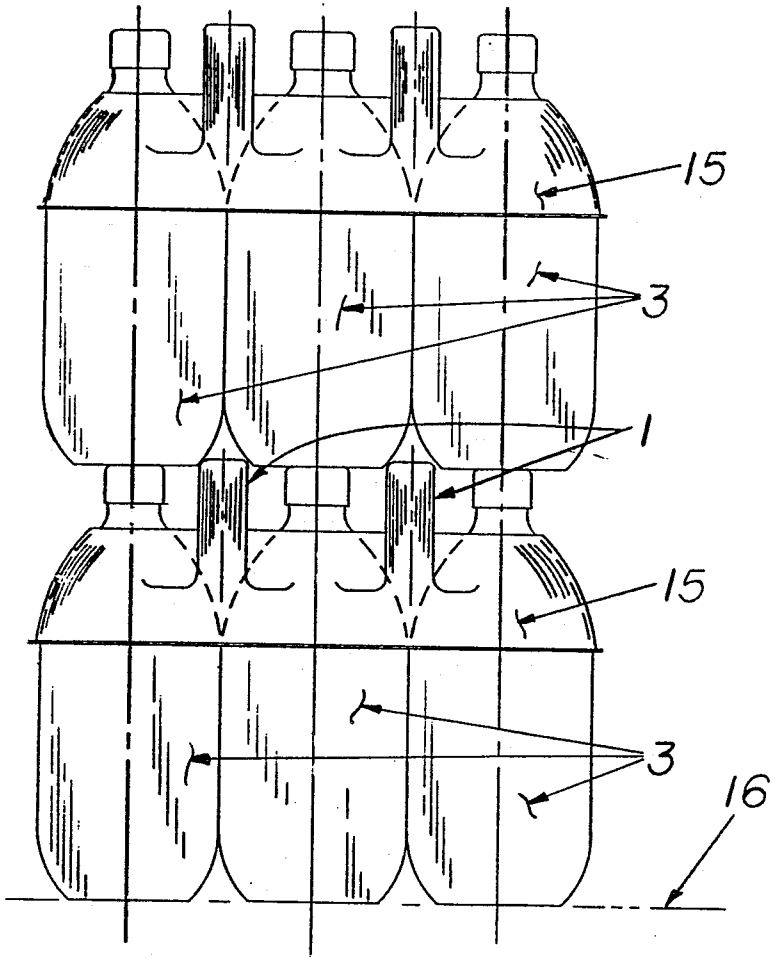
FIG. 11 is a front view of the same species as the holder in FIG. 8 showing the display and stacking capability of this species as they would be typically stacked in a store display.

FIG. 11 and FIG. 12 are front and end views respectively of the container holder (15) and containers (3) as they would commonly be used in a store display or stored prior to opening the container for the first time, supported by surface (16). With the two container holders (15) connected together by tab (14), the container holders (15) will carry a total of six containers. The vertical supports (1) of the container holder (15) are positioned such that when the containers (3) and container holder (15) are stacked one on top of the other as shown, the weight of the container (3) in the upper container holder (15) is supported by the container (3) directly underneath it. This weight distribution will continue thru the stacked units without limitation to the number of containers (3) and container holders (15) being stacked, thereby not limiting the stacking height or weight by the strength of the vertical supports (1) of the container holder (15).

Figure 1:
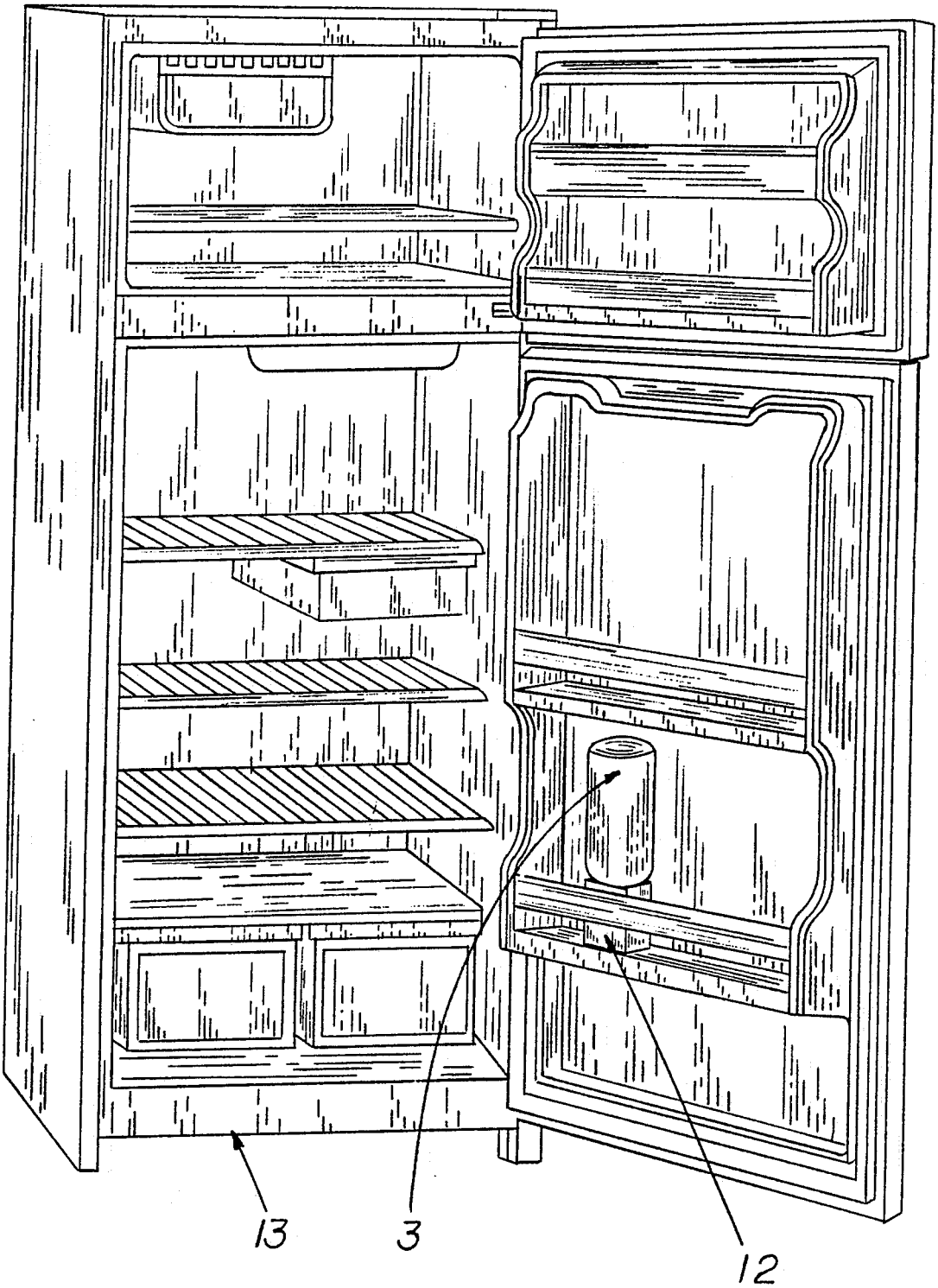
FIG. 1 is a front view of a standard refrigerator with the door open showing the typical use of the present invention.

In operation, the reusable cap on a container of effervescent liquid is placed back on the container after opening. The container is then placed into the container holder in an inverted position. The container holder support will keep the container in the inverted position, causing the liquid inside the container to come in contact with the cap making a liquid seal around the opening preventing the escapement of gas. The drip basin directly under the cap will catch any liquid that may seep from the cap. As shown in FIG. 1, the container holder (12) along with the container (3) can then be stored in a conventional refrigerator (13), in the door shelf, and preserve the effervescence of the liquid.

While preferred embodiments of the present invention, has herein above been described. It will be obvious to one of ordinary skill in the art that other various modifications in regards to material, size and shape may be made without departing from the spirit of the invention and that therefore the scope of the invention is to be limited only by the appended claims.

I claim:

1. A portable holder in combination with a previously opened, capped container of effervescent liquid partially emptied and recapped, said holder supporting said container in an inverted position, whereby, remaining effervescent liquid therein is forced into contact about the interior of the replaced cap causing the liquid to form a seal between the cap and container to prevent the escapement of gas from the container, said combination comprising:

a surrounding hollow upright body including sides and a bottom with a top portion affixed thereon, wherein, the said top portion has a central opening which receives the inverted container and limits the lateral movement of said inverted container, wherein, the said sides of said hollow upright body extend upwardly from the said bottom a distance at least equal to the farthest distance the inverted container must protrude through the said central opening to stabilize said container in an inverted position, wherein, the said sides of said hollow upright body stabilize and support the said top portion, wherein, the said top portion stabilizes the said inverted container, wherein, the said surrounding hollow upright body including said sides and bottom form a drip basin capable of holding liquid and located beneath the central opening in said top portion to collect, if necessary, any possible seepage of liquid past the replaced cap.

2. The combination as claimed in claim 1, wherein the said central opening in the said top portion is partially encircled by depending flanges for receiving, nesting and otherwise supporting said inverted container.

3. A portable holder to support a previously opened container of effervescent liquid partially emptied and recapped, in an inverted position, whereby, remaining effervescent liquid therein is forced into contact about the interior of the replaced cap causing the liquid to form a seal between the cap and container to prevent the escapement of gas from the container, comprising:

a hollow upright body having a top portion with a central opening to receive the exterior of an inverted container and to limit the lateral movement of said inverted container, wherein, said top portion has vertical side supports extending downwardly from said top portion a distance at least equal to the farthest distance the inverted container must protrude through the said central opening to stabilize said container in an inverted position, wherein, the said vertical side supports stabilize and support the said top portion, wherein, the said top portion stabilizes the said inverted container, and a separate drip basin, capable of holding liquid, consisting of a bottom and peripheral flange extending upwardly therefrom to be located beneath the central opening in said top portion, to collect, if necessary, some possible seepage of liquid past the replaced cap, wherein, said vertical side supports are fitted into the said drip basin so that the said vertical side supports engage the bottom thereof and the peripheral flange.

4. A portable holder as claimed in and claim 3, wherein, the said central opening in the said top portion is partially encircled by depending flange for receiving, nesting and otherwise supporting said inverted container.

* * * * *